United States Patent [19]

Elliott

[11] Patent Number: 4,685,757

[45] Date of Patent: Aug. 11, 1987

[54] ELECTRICAL WIRE CONNECTOR AND CONNECTION METHOD

[76] Inventor: Jon S. Elliott, 305 Windsor St., Park Forest, Ill. 60466

[21] Appl. No.: 856,417

[22] Filed: Apr. 18, 1986

[51] Int. Cl.[4] ..... H01R 9/06

[52] U.S. Cl. ..... 439/426; 174/87

[58] Field of Search ..... 339/97 R, 97 P, 98 R, 339/99 R; 174/84 R, 84 S, 87

[56] References Cited

U.S. PATENT DOCUMENTS

| | | | |
|---|---|---|---|
| Re. 26.994 | 12/1970 | Fuller et al. | 174/84 |
| 2,291,434 | 7/1942 | Hollopeter et al. | 173/324 |
| 2,501,187 | 3/1950 | Oortgijsen | 173/324 |
| 2,587,239 | 2/1952 | Smith | 173/340 |
| 2,742,623 | 4/1956 | Odegaard et al. | 339/97 |
| 2,764,748 | 9/1956 | Heller | 339/99 R |
| 3,027,536 | 3/1962 | Pasternak | 174/84 S X |
| 3,201,745 | 8/1965 | Williams | 339/99 |
| 3,320,355 | 5/1967 | Booker | 174/84 |
| 3,328,747 | 6/1967 | Dover et al. | 339/97 R |
| 3,427,553 | 2/1969 | Smulowitz et al. | 339/97 |
| 3,708,611 | 2/1973 | Dinger | 174/84 C |
| 3,766,514 | 10/1973 | Kimm | 339/99 R |
| 3,786,173 | 1/1954 | Vogt | 174/88 S |
| 3,838,206 | 9/1974 | Eklund | 174/87 |
| 4,013,333 | 3/1977 | Chang | 339/98 |
| 4,070,082 | 1/1978 | Werner | 339/98 |
| 4,199,211 | 4/1980 | Kidder | 339/98 |
| 4,202,589 | 5/1980 | Reavis, Jr. et al. | 339/97 R |
| 4,268,104 | 5/1981 | Kidder | 339/98 |

FOREIGN PATENT DOCUMENTS

| | | | |
|---|---|---|---|
| 49327 | 9/1931 | Norway | 174/845 |

*Primary Examiner*—Gil Weidenfeld
*Assistant Examiner*—Glenn L. Webb

[57] ABSTRACT

A connector for connecting electrical wire comprises electrically conductive blade means having an elongated edge, guide means for guiding a wire inserted into the connector past the blade means, and retaining means for retaining the free end of the wire if doubled back and reinserted into the connector on the opposed side of the blade means. The bend formed in the wire engages the blade edge and is drawn therealong if the wire is pulled back to create a slicing action through the wire's insulator which produces a very clean high integrity electrical engagement of the wire's conductive core with the blade edge. Means are provided for wedging the bend formed in the wire tightly against the blade edge if the wire is pulled back to effect a secure mechanical connection of the wire to the blade means.

32 Claims, 19 Drawing Figures

ELECTRICAL WIRE CONNECTOR AND CONNECTION METHOD

BACKGROUND OF THE INVENTION

This invention concerns electrical wire connectors of the type used to make connection with flexible insulated electrical wires or to interconnect two or more such wires, and an associated wire connection method.

The ideal electrical wire connector with which this invention is concerned, though outwardly simple, must meet, in a single device, a very substantial number of rather severe requirements and constraints.

1. Above all it must produce an electrical connection with highest integrity.

2. It must produce a sound mechanical connection which cannot pull out, disconnect, or otherwise fail. It should resist a pull-out force greater than that required to break the connected wires without impairing the integrity of the electrical or mechanical connection therewith.

3. It is important that it be low in materials cost and amenable to automated manufacture for low net manufacturing cost.

4. It should be quick and easy to use, foolproof in completion, and not require any wire stripping, special tools or excessive force or know-how.

5. It should self-adjust to a wide range of wire diameters; that is, one size of connector should fit a wide range of wire diameters.

6. It should be readily disconnectable and if such is desired, and then reconnectable without significant impairment of the electrical or mechanical connection upon reconnection; yet it should not be susceptible to inadvertent disconnection.

7. It must be reliable, have a minimum number of parts, and preferably have no moving parts which might hang up.

8. It should be compact and lightweight.

9. It should be capable of joining a large number of wires for use in applications where manifold wire interconnections are required or desired.

10. It should be capable of capturing and insulating loose wire ends to obviate the need for insulating such ends.

11. It should be resistant to moisture and invasion of other contaminants from the atmosphere.

12. It should be amenable to use in making "T" and "H" connections as well as end-to-end connections.

13. It should be adaptable to either collinear or parallel connection of wires.

A host of devices have been developed and/or disclosed to meet the need for a wire connector of the type described, but all have fallen far short of providing the desired features and capabilities of the ideal connector. Most suffer badly from an inability to provide the necessary high integrity in the electrical and mechanical connections produced. While some are easy to connect, they cannot be readily disconnected and reconnected. Few, if any, have the desirable "one-size-fits-all" capability, being limited to handling one fixed wire size, or a very narrow range of wire sizes. Some designs are hindered by a need for moving parts which inevitably reduces the reliability and raises cost of such devices. Others suffer from a lack of resistance to moisture and other environmental intrusions. Some will provide end-to-end connections, and others a "T" or "H" connection, but few, if any, will provide all of these types of connections in a single connector.

PRIOR ART

| Patent No. | Inventor |
|---|---|
| 2,291,434 | Hollopeter et al |
| 2,501,187 | Oortgijsen |
| 2,587,239 | Smith |
| 2,742,623 | Odegaard et al |
| 3,201,745 | Williams |
| 3,320,355 | Booker |
| 3,328,747 | Dover et al |
| 3,427,553 | Smulowitz et al |
| 3,708,611 | Dinger |
| 3,766,514 | Kimm |
| 3,786,173 | Vogt |
| 4,070,082 | Werner |
| 4,013,333 | Chang |
| 4,268,104 | Kidder |
| Re. 26,994 | Fuller et al |

OBJECTS OF THE INVENTION

It is an object of this invention to provide an electrical wire connector and associated connection method meeting each of the above-identified requirements and constraints of an ideal flexible insulated wire connector.

DESCRIPTION OF THE FIGURES

FIG. 1 is a plan view.

FIG. 2 is a side elevation view and FIG. 3 is an end elevation view of the connector.

FIGS. 4–6 show the method of connection.

FIG. 7 is a partially sectioned assembly view showing connection of wires of different sizes.

FIG. 8 is an exploded view;

FIGS. 9–11 illustrate a method of connection;

FIG. 12 is a partially sectioned assembly view showing two wires interconnected.

FIGS. 13, 14 and 15 are partially sectioned plan, side elevation and end elevation views.

FIGS. 16–18 are method-of-assembly views.

FIG. 19 is a partially sectioned assembly view showing two wires interconnected.

DESCRIPTION OF THE PREFERRED EMBODIMENTS

Figure 1:
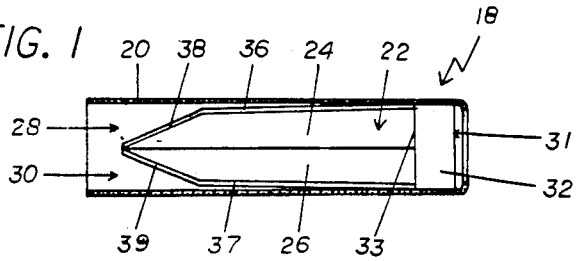
FIGS. 1–7 depict a wire connector representing a preferred embodiment of the invention.

This invention is directed to an improved wire connector of the type used to make connection with a flexible insulated electrical wire or to interconnect a plurality of such wires together. As used herein the term "flexible" means capable of being bent by hand, that is, without the use of pliars or other tools. In general terms, one output of this invention is a wire connector comprising wire conduit means and electrically conductive blade means positioned within the conduit means. The conduit means and the blade means are structured and arranged such that a wire inserted through the conduit means and reinserted back into the outlet end thereof but on the opposite side of the blade means will have the bend formed in the wire drawn along the blade means if the wire is pulled back, causing the blade means to slice through the wire's insulation and make physical and electrical engagement with the electrically conductive core. Wedging means is provided which is so structured and positioned relative to said blade means that as the wire is pulled back, the bend slides along the blade means and is firmly wedged between the wedging means and the blade means to make a sound electrical and mechanical connection between the wire and the connector.

In applications wherein the connector may be hard-wired, as to a ground conductor or a power source, e.g., it may be desired to connect a single wire to the connector, however, in most applications, it will be desired to interconnect a plurality of wires. As will be described in detail hereinafter, by this invention, as many as 20 or more wires of like or varying sizes may be soundly electrically and mechanically interconnected with great ease, using a very low cost connector which is essentially foolproof and highly reliable, requires no tools for assembly, is moisture resistant, is easily disconnected and reconnected if desired, is extremely compact, and is amenable to use in a multitude of applications and adaptations.

FIGS. 1–7 illustrate a preferred embodiment of the principles of the invention. The FIGS. 1–7 connector 18 comprises guide or conduit means, here shown as taking the form of a tube 20, and blade means, here shown as an electrically conductive blade 22. The blade 22 is captured within and supported by the tube 20. In the illustrated preferred embodiment, the blade 22 is shown as having a "V"-shaped cross-section. The two legs 24, 26 of the blade 22 are joined at the base of the blade 22 along a bend line 27 and define blade edges 28, 30, respectively.

It is important that the blade 22 not be collapsed by the user's fingers during the connection operation. For this reason, in the illustrated preferred embodiment, the blade 22 has at its inlet end a reinforcing section 31. The reinforcing section 31 has a brace 32 closing the "V" cross-section and preventing collapse of the blade 22. The reinforcing section thus defines a bore for passing and containing a plurality of wires and offers means for the user to hold the device when effecting the wire connections without collapsing the blade onto the wires being connected and preventing normal wire connection. The reinforcing section fits tightly in the tube 20 and also serves to insure against inadvertent withdrawal of the blade 22 from the tube 20 during the connection operation or after the connection is made.

The edge 33 of brace 32 defines wire stops at the terminus at each of the blade edges 28, 30. The blade edges 28, 30 have wire storage sections 36, 37 adjacent the respective stops upon which connected wires are stored, as will be described. The blade edges 28, 30 also have transition sections 38, 39 for guiding the wires being connected up onto the storage sections 36, 37 of the blade edges 28, 30.

Figure 4:
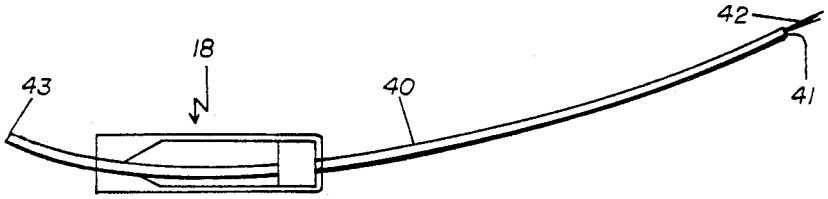
Figure 5:
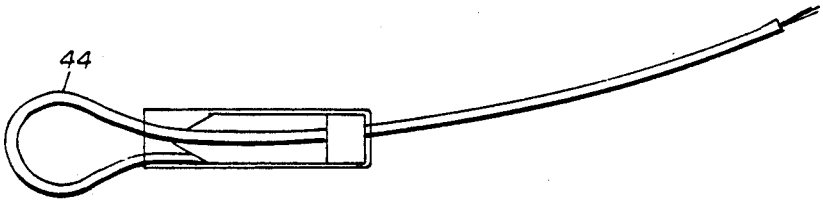
Figure 6:
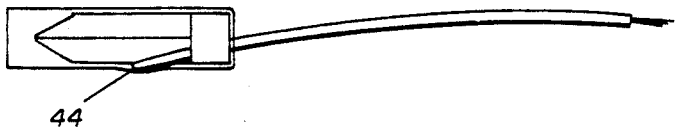

A quick and easy method for connecting a flexible insulated wire to the connector, or multiple wires to each other, will now be described. Refer to FIGS. 4–6. The invention is preferably used to connect wire such as shown at 40 having a layer of insulation 41 surrounding an electrically conductive core 42. Simply insert a wire 40 through the guide or conduit (the tube 20 in this embodiment), passing it through the V-channel formed by the legs 24, 26 of the blade 22. Then insert the free end 43 of the wire 40 back into the tube but on the opposite side of one of the legs 24, 26 (here shown as leg 26), that is, between the tube 20 and the leg 26. In the most common application wherein it is desired to contain and insulate the free end 43, it is not passed completely through the tube 20, but rather tucked within the space between the blade and tube 20. The wire 40 is then simply pulled back such that the bend 44 formed in the wire 40 by the reinsertion operation is drawn along the wrapped blade edge 30, causing the blade edge 30 to slice through the wire's insulation 41 and make electrical engagement with the conductive core 42 of the wire.

As the wire pull-back is continued, the wire bend 44 leaves the transition section 39 and is drawn up onto the storage section 37 of the blade edge 30.

Figure 7:
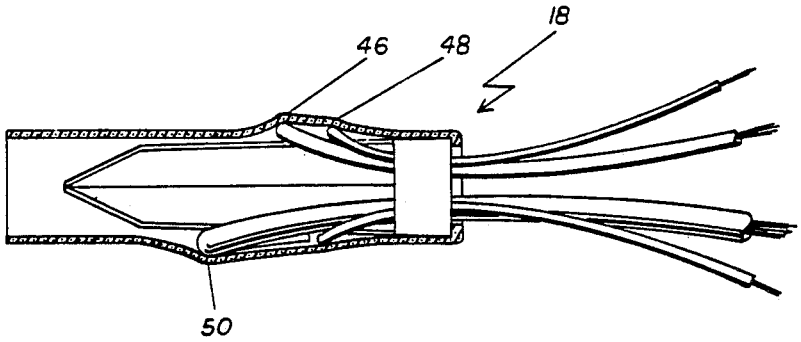
Figure 8:
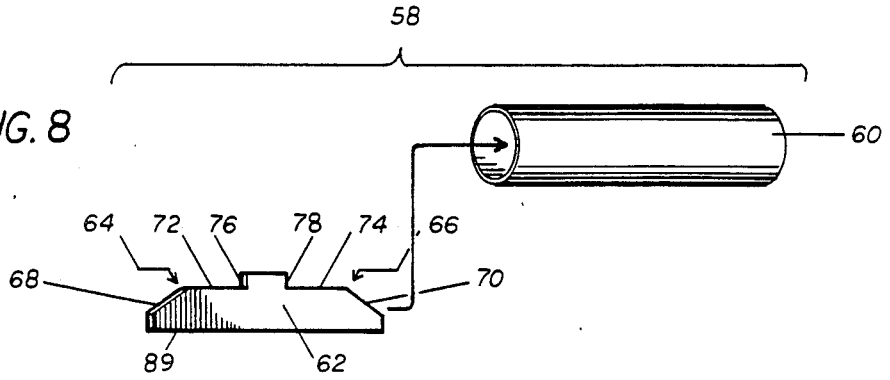
FIGS. 8–12 depict an alternative embodiment of the invention adapted for connecting two wires in a collinear configuration.
Figure 9:
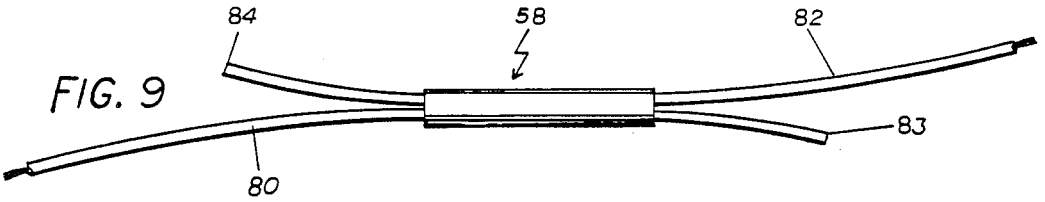
Figure 10:
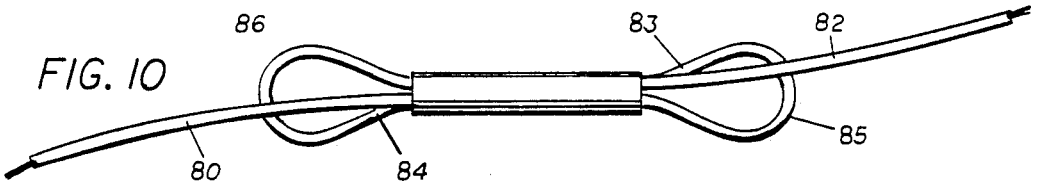
Figure 11:
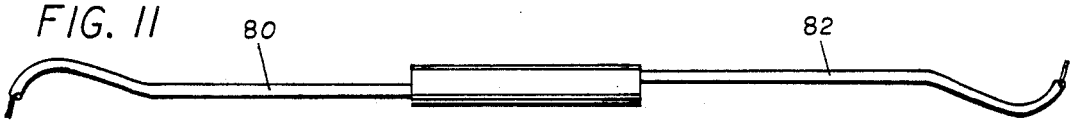

In the illustrated preferred embodiment, the storage sections 36, 37 of the blade edges 28, 30 have a gentle taper or slope relative to the axis of the tube 20. By this arrangement, the bend 44 in a wire being connected can easily enter the storage section as the wire is being pulled back. However, as the pulling continues, the interference between the wire bend 44 and the tube 20 increases (or begins and then increases in the case of a small diameter wire) until a very significant wedging action on the wire bend 44 is produced between the tube 20 and storage section 37 of the blade edge 30. For larger diameter wires, the wire bend may never reach its stopped against edge 33 of brace 32; for smaller wires it may. The flexibility of the tube 20 is an important attribute which enables the connector 18 to accommodate wires in a range of sizes, as shown in FIG. 7. Areas of flexure of the tube 20 to accommodate the illustrated wires of differing diameter as shown at 46, 48 and 50 in Figure 7. In FIG. 7, the tube 20 is shown in its non-heat-shrunk state.

The tube 20 is dimensioned relative to the blade 22 such that the bend 44 in the wire 40 cannot be drawn to the end of the storage section 37 of the blade edge 30 without causing the tube 20 to flex. As noted, the tube 20 flexes to accommodate the bend 44, the bend 44 is firmly wedged between the blade edge 30 and the tube 20 makes sound electrical and mechanical connection between the wire 40 and the connector 18. The wedging action produced is firm, yet not severe due to the resilience in the tube 20, reducing the possibility of the wire being severed during the connection operation. If it is desired to mechanically and electrically interconnect a plurality of wires, the procedure is repeated for each wire, using either, but preferably both, of the blade legs 24, 26.

The conduit (tube 20) serves a number of important functions. It serves during wire insertion to guide the wire past the blade in the direction generally parallel to the blade. During reinsertion, it serves to assist in retaining the free end of the wire. It serves as the anvil part of the system which exerts the all-important wedging action on the wire bend.

The conduit may be rigid (or semi-rigid), but is preferably flexible, as shown, in order that wires in a wide range of sizes may be interconnected. A rigid or semi-rigid conduit is best suited for applications where wires of a fixed size or narrow range of sizes are to be interconnected. I have demonstrated that using a flexible conduit such as a plastic tube, wires with a diameter range of 2:1 can be soundly interconnected with this invention.

The conduit also serves as a barrier to moisture and other environmental contaminants. The conduit is preferably composed of a heat-shrinkable tubular material such as Nylon TM, for use in applications where maximum resistance to the environment is desired. In those applications, the user may apply heat after the connections are made to cause the conduit to shrink tightly around the interconnected wires. Heat shrinking also serves to further insure against an inadvertent disconnection of the wires, as could possibly happen if very stiff wires are used.

Other materials, preferably flexible for the reasons given, may be employed (rubber, for example). The tube, however, is preferably transparent in order that the user can see the wires that he is connecting, thus facilitating the interconnection operation. Cross-sectional section shapes other than round may be employed—e.g., triangular or elliptical.

An important function of the conduit is to support the blade against accidental pull-out during the process of connecting the wires. If the blade is not snugly retained within the conduit, it could possibly be withdrawn as the wire is pulled. I have found that the FIGS. 1–7 embodiment with a blade 22 having a "V" cross-section makes a snug three-point fit within the tube 20 and is not prone to dislodgment during the wire connection process. The conduit also serves to support the blade against forces which tend to collapse it during the connection operation. More on that subject later.

The blade 22 must be composed of an electrically conductive material. It must be such as to have an adequate cutting edge or edges. I have found that brass sheet of 0.010 mm thickness creates a natural cutting edge which works well without honing. The edge works better if it is smooth, as a serrated or rough edge might tear up or possibly sever a wire as it is drawn across the blade edge. Once the insulation is cut and metal-to-metal contact is made, the wire bend slides smoothly across the transition section and onto the storage section of the blade edge without damage to the wire core.

One of the important attributes of the invention is that it makes an extremely good electrical engagement between the blade and the connected wires. Unlike certain prior devices which attempt to push a needle pierce point or blade through the wire's insulation, my connector creates a combined slicing, and wiping action between the blade and wire as the wire is connected. Further, in the common application wherein wires are joined end-to-end and the free end of the wire is captured within the device, as the wire to be connected is pulled back (with the free end retained between the blade and tube wall), the bend actually travels along the wire toward the wire's free end, creating a scraping (as well as slicing) action at the interface between the wire and blade edge. This combined slicing-scraping engagement of the wire and blade edge produce an extremely clean contact of the highest electrical integrity.

The number of wires which may be interconnected with the invention is limited only by the length of the storage sections on the blade edge and the diameter of the device relative to the diameter of the wire, that is, by the number of wires which can reside side-by-side on the storage sections of the blade edges and the number of wires which can be received by the bore of the device. I have demonstrated that twenty or more wires can be interconnected without any impairment of the mechanical or electrical integrity of the connections formed. As a side benefit, I have found that as a relatively larger number of wires are added, the tube 20 tends to close down on the stored wires and reduce the possibility of the wires backing off the engaged storage section and becoming disconnected.

As explained, if the conduit is flexible, such as plastic tube 20, wires of different sizes can be interconnected. It is preferred that, for reasons of improved retention, if wires of varying sizes are to be used, that the smaller size wires be connected first.

Each of the transition sections 38, 39 of the blade edges 28, 30 may have any of a variety of configurations. Its function is to guide the wire bend onto the storage section without any hang-up of the bend on the blade edge. There should be no sharp corners or other impediments to smooth movement of the bend across the blade edge. Many blade edge configurations envisioned will not have the clear demarcation between the transition and storage sections shown in the FIGS. 1–7 embodiment. It is desirable to have the transition section as short as possible consistent with the above, in order to minimize the overall length of the connector.

Returning to the subject of blade support and structure—the blade in the FIGS. 1–7 embodiment is favorably structured from the standpoint of resistance to collapsing when the wires are pulled. It will be understood why the pulling of the wires, particularly during the making of end-to-end connections, tends to collapse the blade if it is recalled that the free end remains stationary. That is, the bend does not merely slide up the blade—the bend actually moves toward the free end of the wire. The ever-moving bend thus forms in effect, a hook which tends to catch the blade edge and draw the blade in as the wire is pulled.

I have found that a "U" cross-sectional configuration of the blade did not work as well as a "V" cross-section, as the legs of the blade tended to collapse inwardly when the wires were pulled. The triangular configuration of the FIGS. 1–7 embodiment better resists collapsing of the blade.

Figure 2:
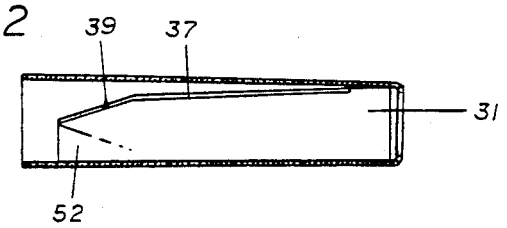
Figure 3:
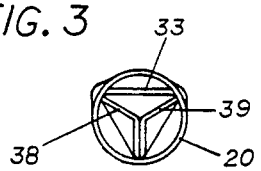

In order to further strengthen the blade against collapsing forces, it is preferred that the outlet end of the blade is pinched above the blade bend line 27 at one angle thereto, as shown, for example, in FIG. 2 at 52. Structuring the blade end in that way has a number of purposes; (1) it effectively shortens the legs 24, 26 of the "V" and widens the angle of the "V" at the outlet end of the connector, thus increasing the blade's resistance to the collapsing forces produced when the wires are pulled across the blade; and (2) it opens and widens the interstitial space between the conduit (tube 20) and the blade legs on both sides, making it easier to reinsert the free end 43 of the wire 40; (3) it raises the exit point of the free end 43 of the wire 40 from the channel formed by the blade legs 24, 26, thus decreasing the possibility that the wire will hang up in the transition section of the blade edge.

The FIGS. 1–7 connector 18 provides fo easy disconnection of connected wires. Simply grasp the connector in one hand and, holding the last-connected wire up close to the connector, push it rearwardly off the engaged blade edge and out of the outlet end of the connector. It may then be reconnected in the same manner as it was connected without any significant impairment of the integrity of the electrical and mechanical connections produced.

I have constructed and satisfactorily tested a connector as shown in FIGS. 2–7 having the following specifications. The conduit is Nylon TM tubing with an inside diameter of 6 mm, a wall thickness of 0.01 inch , and a length of 32 mm. The blade is of brass sheet, 0.010 inch in thickness, 25 mm in length, 10.1 mm in width (planiform dimension) at the outlet end; with 5.5 mm length of taper at outlet end (axial dimension).

FIGS. 8–12 illustrate another embodiment of the invention. The FIGS. 8–12 connector 58 has many of the same features as the FIGS. 1–7 embodiment but is adapted especially for connecting two flexible wires in collinear fashion—that is, end-to-end. It is illustrated as comprising, in its preferred form, a guide or conduit means in the form of a flexible tube 60 which may be of the same general construction and composition as the tube 20 in the FIGS. 1–7 embodiment.

The blade 62 in this embodiment, however, is somewhat different. It is planar and is double ended, that is, both ends have the same construction. Blade 62 is shown as comprising (in mirror image arrangement) blade edges 64, 66, having transition sections 68, 70 and storage sections 72, 74. The blade defines stops 76, 78 adjacent the respective storage sections 72, 74. See FIGS. 9–11. The tube 60 and blade 62 are structured and arranged such that two wires 80, 82 inserted through the tube 60 from opposite ends, then reinserted by their free ends 83, 84 at opposite ends of the tube 60 between the tube 60 and the respective opposed side of the blade 62, and the wires 80, 82 pulled in opposite directions, will cause the respective bends 84, 86 formed in the wires to be drawn along the respective blade edges toward each other, causing the blade edges 64, 66 to slice through the insulation on the wires 80, 82. Physical and electrical engagement with the conductive wire cores is thus made. The tube 60 and blade 62 are relatively dimensioned such that as the wires 80, 82 are pulled in opposite directions, the tube 60 flexes to accommodate the respective wire bends 85, 86, and the bends slide along the respective blade edges 64, 66 and are firmly wedged between the tube 60 and the respective blade edges to make a sound electrical and mechanical connection between the wires.

As discussed above, the storage sections of the blade edges may be tapered relative to the means which produces the wedging action on the wire, or if the said means is flexible, the storage sections of the blade edges may be substantially parallel thereto. The blade of the FIGS. 8–12 embodiment illustrates the latter case, whereas, as noted, the FIGS. 1–7 embodiment illustrates the former case. Note at 87, 88 the points in the tube 60 where the tube flexes to accommodate the wires 80, 82 and produce a firm wedging action of the bends 85, 86 in the wires 80, 82 against the storage sections 74, 72 of the blade edges 64, 66.

In the FIG. 8–12 embodiment, the wires are preferably pulled simultaneously from opposite ends so that each acts as a restraint for the other as it is pulled. The FIGS. 8–12 embodiment does not have a reinforcing section to prevent the connector from being pinched if held by a user during an assembly operation—hence the desirability of pulling two wires in opposite directions at the same time.

The FIGS. 8–12 embodiment is basically like the FIGS. 1–7 embodiment in structure, function and features, except that it is planar rather than having a "V" cross-section. Both embodiments have two blade edges, the FIGS. 8–12 embodiment having the blade edges at opposed ends, rather than side-by-side in a "V" configuration as in the FIGS. 1–7 embodiment.

The above discussed with respect to the FIGS. 1–7 embodiment should be applied equally to the FIGS. 8–12 embodiment except as noted. The FIGS. 1–7 embodiment is capable of holding more wires because of the greater capacity of the bore in the FIGS. 1–7 connector.

Figure 12:
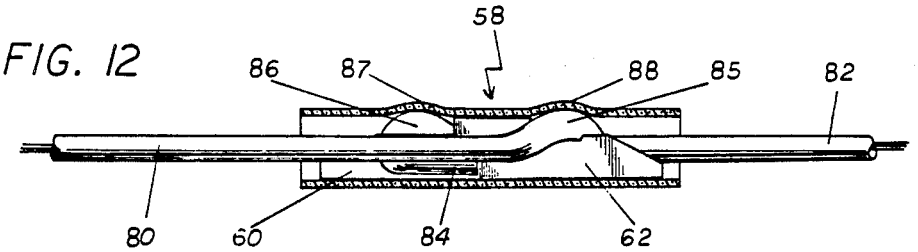
Figure 13:
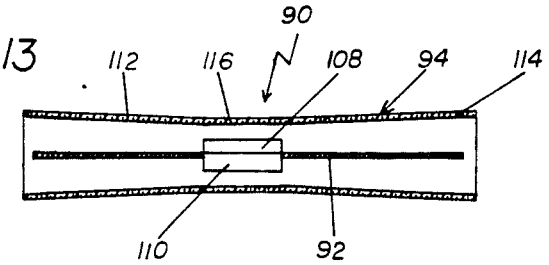
FIGS. 13–19 depict yet another embodiment of the invention.
Figure 14:
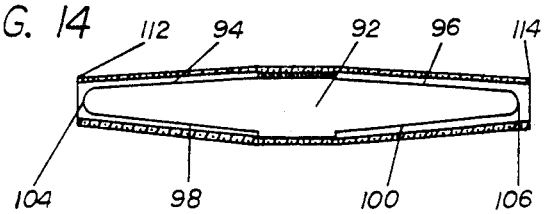
Figure 15:
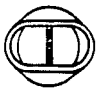

The FIGS. 8–12 collinear embodiment has the advantage relative to the FIGS. 1–7 embodiment of being extremely small in cross-sectional profile, especially if the tube 60 is heat shrunk after interconnection of the wires. In FIG. 12 the tube 60 is shown in its non-heat-shrunk state.

I have constructed and successfully tested a connector as shown in FIGS. 8–12 having generally the following specifications. The conduit is a Nylon TM tube about 30 mm long, with an inside diameter of 5 mm, and a wall thickness of 0.080 inch. The blade is of 0.01 inch brass sheet, semi-hard, or of sheet material of commensurate strength, conductivity and resiliency. The blade has a length of about 25 mm. The distance between the stops 76, 78 is 10 mm; the height from the blade bottom edge 88 to the storage sections 72, 74 of the blade edges 64, 66 is 3.5 mm.

Each of the above-described embodiments has been discussed in the context of use in making end-to-end connections. The connector of this invention can as well be adapted to make "H" or "T" connections. To connect two wires in an "H" configuration, rather than insert the free end into the connector after it is doubled back, it is fed completely through the connector to the desired length before the wire is pulled back. The second wire is treated the same way to make the "H" interconnection. If only one of the wires is fed all the way back through the other is end-terminated, the result is a "T" interconnection.

FIGS. 13–19 illustrate yet another important embodiment of the invention. The FIGS. 13–19 embodiment represents a variant of the FIGS. 8–12 embodiment. The FIGS. 13–19 connector 90 comprises a blade 92 captured within guide means in the form of a tube 94. The blade 92 is not only double ended like the blade 62 in the FIGS. 8–12 embodiment, but is also double sided, that is having a similar structure top and bottom as well as end-to-end. The blade 92 includes four blade edges 96, 98, 100 and 102. At the ends of the blade 92 are noses 104, 106. The noses serve as substitutes for the transition sections described in the above described embodiments, guiding a reinserted wire in either direction to one of the blade edges 94, 98 at one end or blade edges 96, 100 at the opposed end.

In the FIGS. 13–19 embodiment, the blade edges 94, 96, 98, 100 do not have clearly demarcated storage sections and transition sections, the junction from one to the other being nondistinct.

Located medially in the blade 92 are two transverse extensions 108, 110 at the top and bottom of the blade 92. The transverse extensions 108, 110 serve a number of functions. First, they serve to fill the tube and thus greatly assist in the retention of the blade 92 within the tube 94. Secondly, during the connection operation, the transverse extensions 108, 110 serve to hold the users finger grip away from the wires and allow the wires to be threaded through and pulled back through the connector. Additionally, they give the blade some structural rigidity in its medial section. Still another important function is to provide stops for the wires to prevent them being pulled through the connector during a connection operation. They thus serve the same function in this regard as brace 32 in the FIGS. 1–7 embodiment, and stops 76, 78 in the FIGS. 8–12 embodiment.

The tube, as in the aforedescribed embodiments, is preferably a conduit in the form of a plastic tube, such as Nylon TM, and preferably transparent to assist in the connection operation. It also may be composed of other suitable materials, as described above. The tube 94 in the FIGS. 13–19 embodiment is somewhat different from the tubes described above, in that it is formed to have a non-cylindrical shape. As shown with particular clarity in FIG. 15, the tube ends 112, 114 are flared laterally. This provides a number of benefits. First, the flaring of the ends greatly improves the retention of the blade 92 within the tube 94, preventing withdrawal during a connection operation. Secondly, and also of great importance, the flaring of the ends 112, 114 of the tube also serves to enlarge the exit passageways on either side of the blade 92, greatly facilitating reinsertion of a wire free end during a connection operation. The larger effective passageways on opposite sides of the blade at the ends of the connector 90 make possible facile connection of a relatively large number of wires which are easily accommodated by the four blade edges, 94, 96, 98, 100.

Figure 16:
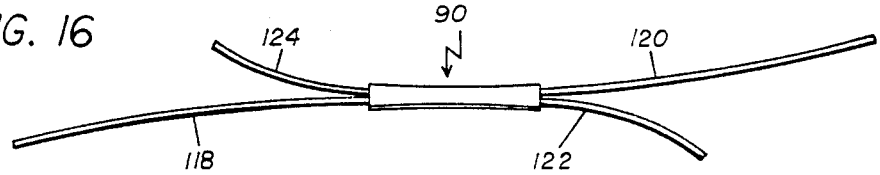
Figure 17:
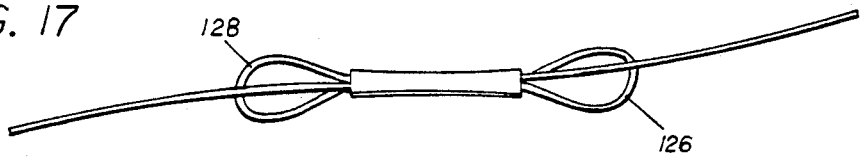
Figure 18:
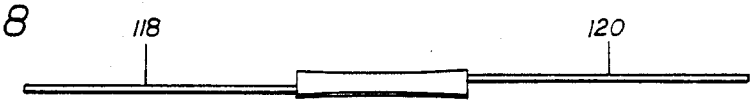

Interconnection of two wires 118, 120 using the connector 90 is shown in FIGS. 16, 17 and 18. As in the FIGS. 8–12 embodiment, the wires 118, 120 are inserted through the connector 90 on opposite sides of the blade 92. The free ends 122, 124 are then reinserted in the end of the connector from which they exited, but on the opposed side of the blade 92. The wires 118, 120 are then pulled back, drawing the wire bends 126, 128 within the device and across the noses 104, 106 and onto one of the blade edges 94, 98 on one end and 96, 100 at the opposed end.

It does not matter which of the blade edges is engaged by a wire bend, as all will work equally well. Unlike the FIGS. 8–12 embodiment the FIGS. 13–19 embodiment has no polarity, either end-to-end or up and down. This makes use of the device much easier in that it does not have to be oriented before use.

Figure 19:
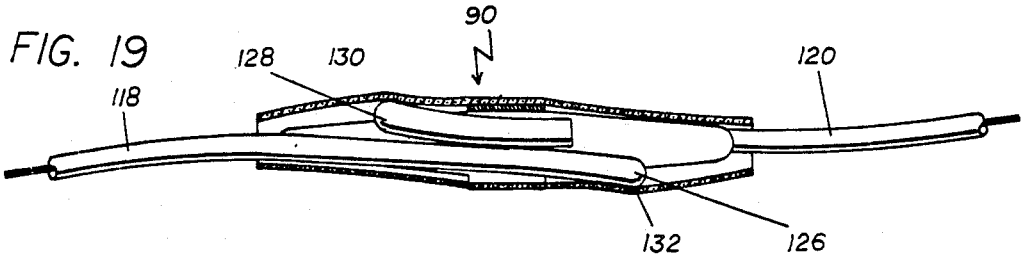

Pulling back on the wires 118, 120 causes the bends 126, 128 to be drawn along two of the blade edges, with the result that the engaged blade edges will slice through the wires insulation and make physical and electrical engagement with the electrically conductive cores of the connected wires. As in the above-described embodiments, the blade 92 is dimensioned relative to the tube 94 such that as the wires are pulled back, the wire bends slide along the engaged blade edges and the tube flexes to accommodate the bends. The bends in the wire thus formed are firmly wedged between the tube and the engaged blade edge to make a sound electrical and mechanical connection between the wire and the blade, whereby two or more wires thus connected to the connector will be soundly, electrically and mechanically interconnected with each other. The final result is as shown in FIG. 19. It shows wire bend 128 engaging blade edge 94 and wire bend 126 engaging blade edge 100. The bends 126, 128 are wedged tightly between the flexed tube 94 and the engaged blade edges 100, 94. The flexure points in the tube 94 to accommodate the bends 126, 130 are shown in FIG. 19 at 132, 130.

Other variants are envisioned. For example, rather than a blade such as shown at 92 in FIGS. 13–19 having a medial section with a "Z" cross-section, it is contemplated that the medial section could have an "H" cross-section with transverse extensions in both directions at both the top and bottom of the blade. This configuration would add even greater retention of the blade within the tube, further increase the structural strength of the medial section of the blade, and provide passageways on either side of the blade in the medial section of the connector preventing pinching of the wires during a connection operation by the user's fingers.

The above-described embodiments of the invention are intended to be illustrative only and not limiting in any sense. Other embodiments are contemplated. In each embodiment, guide means are provided for guiding a wire inserted into the conductor past the blade means. A full or partial length conduit is not necessary. Means for retaining the free end of the wire which is doubled back and reinserted into the conductor need not be conduit means; it only need retain the free end on the opposed side of the blade so that as the wire is pulled back, the bend formed in the wire is drawn along the blade's edge to produce the desired slicing action. Further, the wedging means can be other than the conduit means which guides the wire. The wedging means need only act to force the wire bend down on the blade edge in a secure wedging action to effect a sound mechanical connection of the wire to the blade. The afore-described embodiments and other embodiments within the spirit and scope of the invention are distinctly claimed and particularly pointed out in the appended claims.

What is claimed is:

1. A connector for connecting electrical wire, comprising:

electrically conductive blade means having an elongated edge;

guide means separate from said blade means for guiding a wire inserted into the connector past said blade means;

retaining means for retaining the free end of the wire when it is doubled back and reinserted into the connector on the opposite side of said blade means; and means for wedging the bend formed in the wire tightly against said blade edge as the wire is pulled back, without movement of said blade means relative to said guide means, to thereby effect a secure mechanical connection of the wire to said blade means.

2. The connector defined by claim 1 wherein said guide means, said retaining means and said means for wedging constitute portions of a flexible tube within which said blade means is captured.

3. A connector for connecting flexible insulated electrical wire, comprising:

electrically conductive blade means having an edge;

guide means separate from said blade means for guiding a wire inserted into the connector past said blade means; and retaining means for retaining the free end of the wire when it is doubled back and reinserted into the connector on the opposed side of said blade means, such that the bend formed in the wire engages said blade edge and is drawn therealong as the wire is pulled back, without movement of said blade means relative to said guide means, to thereby create a slicing action through the wire's insulator which produces a very clean, high integrity electrical engagement of the wire's conductive core with said blade edge.

4. The connector defined by claim 3 wherein said guide means and said retaining means constitute portions of a flexible tube within which said blade means is captured.

5. A connector for connecting flexible insulated electrical wire, comprising:

electrically conductive blade means having an edge and being immovably retained in said connector;

guide means for guiding a wire inserted into the connector past said blade means in a direction generally parallel to said blade means;

retaining means for retaining the free end of the wire when it is doubled back and reinserted into the connector on the opposed side of said blade means, such that the bend formed in the wire engages said blade edge and is drawn therealong as the wire is pulled back to create a slicing action through the wires insulator which produces a very clean, high integrity electrical engagement of the wire's conductive core with said blade edge; and means for wedging the bend formed in the wire tightly against said blade edge as the wire is pulled back to effect a secure mechanical connection of the wire to said blade means.

6. The connector defined by claim 5 wherein said guide means, said retaining means, and said wedging means constitute portions of a flexible tube within which said blade means is captured.

7. A wire connector for connecting flexible electrical wire having an insulated, electrically conductive core, comprising:

wire conduit means; and electrically conductive blade means positioned within said conduit means, said conduit means and said blade means being structured and arranged such that a wire inserted through said conduit means and reinserted back into the outlet end thereof but on the opposite side of said blade means will have the bend formed in the wire drawn along said blade means as the wire is pulled back, causing said blade means to slice through the wire's insulation and make physical and electrical engagement with the wire's electrically conductive core; and wedging means structured and positioned relative to said blade means such that as the wire is pulled back, the wire bend slides along said said blade means and is firmly wedged between said wedging means and said blade means to make a sound electrical and mechanical connection between the wire and the connector.

8. The connector defined by claim 7 wherein said wedging means constitutes a portion of said conduit means.

9. A wire connector for quickly and easily interconnecting a plurality of flexible electrical wires having an insulated electrically conductive core, said connector comprising:

wire conduit means in the form of a flexible plastic tube;

an electrically conductive blade captured within said tube, said tube and said blade being structured and arranged such that a wire which is inserted through said tube adjacent said blade and reinserted back into the outlet end of said tube between said tube and the opposite side of said blade will have the bend which is formed in the wire drawn along an edge of said blade as the wire is pulled back, causing said blade edge to slice through the wire's insulation and make physical and electrical engagement with the electrically conductive core of the wire, said tube and said blade being dimensioned relative to each other such that as the wire is pulled back, the wire bend slides along the said blade edge, said tube flexes to accommodate it, and said bend is firmly wedged between said tube and said blade edge to make a sound electrical and mechanical connection between the wire and said connector, whereby multiple wires thus connected to the connector will be soundly electrically and mechanically interconnected with each other.

10. The connector defined by claim 9 wherein said blade edge includes a storage section on which multiple connected wires of like or varying diameters may be stored in wedged engagement between said blade edge and said tube, wherein said blade includes wire stop means adjacent said storage section of said blade edge for preventing pull-through of connected wires, and wherein said blade edge includes a transition section adjacent said storage section for guiding the wire bend up onto the storage section of the blade edge when the wire is pulled.

11. A wire connector for quickly and easily interconnecting a plurality of flexible electrical wires having an insulated electrically conductive core, said connection comprising:

wire conduit means in the form of a flexible plastic tube; and captured within said tube, an elongated electrically conductive blade of "V" cross-section having a blade edge on each leg of the "V", said tube and said blade being structured and arranged such that a wire which is inserted through the tube between said legs of said blade and reinserted back into the outlet end of said tube but on the opposite side of one of said blade legs will have the bend which is formed in the wire drawn along the blade edge on that leg as the wire is pulled back, causing the blade edge to slice through the wire's insulation and make physical and electrical engagement with the conductive core, said tube and said blade being dimensioned relative to each other such that as the wire is pulled back, the wire bend slides along the engaged blade edge, said tube flexes to accommodate it, and the bend is firmly wedged between said blade edge and said tube to make a sound electrical and mechanical connection between the wire and said connector, whereby multiple wires thus connected to the connector over either or both legs of the blade will be soundly, electrically and mechanically interconnected with each other.

12. The connector defined by claim 11 wherein said blade includes wire stop means adjacent said storage section of said blade edge for preventing pull-through of connected wires.

13. The connector defined by claim 12 wherein at the outlet end of said connector, said blade is pinched above the blade bend line at an angle relative to the bend line to enlarge the openings between the blade and the tube on both sides of the blade to facilitate reinsertion of passed wires into the connector, and to strengthen said blade against inward collapsing thereof when the wires are pulled.

14. The connector defined by claim 12 wherein said blade edge includes a storage section adjacent said stop means on which multiple connected wires of like or different diameters may be stored in wedged engagement between said blade edge and said tube.

15. The connector defined by claim 12 wherein said blade includes at the wire inlet end a reinforced section defining a tubular bore for passing and containing a plurality of wires and for preventing collapsing of the inlet and of said blade during the connection operation.

16. A wire connector for quickly and easily making collinear interconnections between two flexible electrical wires which have an insulated electrically conductive core, said connector comprising:

wire conduit means in the form of a flexible plastic tube; and a planar double-ended electrically conductive blade captured within the tube, said blade having a blade edge on each end, the tube and the blade being structured and arranged such that two wires which are inserted through the tube from opposite ends, reinserted back into the opposite ends of said tube between said tube and the opposed side of said blade, and the wires pulled in opposite directions, will cause the respective bends formed in the wires to be drawn along the respective blade edges toward each other, causing said blade edges to slice through the two wires' insulation and make physical and electrical engagement with the wire cores, said tube and said blade being dimensioned relative to each other such that as the wires are pulled in opposite directions, said tube flexes to accommodate the respective wire bends, and the bends slide along the respective blade edges and are firmly wedged between said tube and the respective blade edges to make a sound electrical and mechanical connection between the wires.

17. The connector defined by claim 16 wherein said blade has wire stop means adjacent to each of said blade edges.

18. A connector defined by claim 17 wherein said blade edges each have a storage section adjacent a respective one of said stop means on which multiple connected wires of like or differing diameters may be stored in wedged engagement between said blade edge and said tube, and wherein each of said blade edge includes a transition section for guiding the engaged wire bend up onto said storage section of said blade edge when the wire is pulled.

19. The connector defined by claim 16 wherein said blade has a pair of blade edges on the top and bottom thereof as well as on each end, each end of the blade defining a nose for guiding the bend in a pulled wire up onto one of the blade edges.

20. A wire connector comprising a flexible conduit and an electrically conductive blade captured within said conduit, said connector defining a passageway on both sides of said blade for passing wires to be connected, said blade having at least one cutting edge.

21. The connector defined by claim 20 wherein said blade is planar and has a similar structure on both ends, defining blade edges at each end of the connector.

22. The connector defined by claim 20 wherein said blade is planar and has a similar structure top and bottom, defining blade edges on the top and bottom of said blade.

23. The connector defined by claim 20 wherein said blade is planar and has a mirror image structure both top and bottom and end to end, defining four blade edges, two at each end of the connector.

24. The connector defined by claim 20 wherein said blade is planar and has wire stop means extending transversely from the blade to stop wires from being pulled through the connector and to assist in retaining the blade within the tube.

25. The connector defined by claim 24 wherein said blade has a mirror image structure on both ends and top and bottom to define four blade edges with two at each end of the blade, and wherein said blade has a nose at each end thereof serving to guide a pulled wire up onto one of the adjacent blade edges.

26. A wire connector for quickly and easily interconnecting a plurality of flexible electrical wires having an insulated electrically conductive core, comprising:

wire conduit means in the form of a flexible heat-shrinkable plastic tube; and captured within said tube, an elongated electrically conductive blade of "V" cross-section having wire stop means and adjacent thereto a blade edge on each leg of the "V", said tube and said blade being structured and arranged such that a wire which is inserted through said tube between said legs of said blade and reinserted back into the outlet end of said tube but on the opposite side of one of said blade legs will have the bend formed in the wire drawn along said blade edge on that leg as the wire is pulled back, causing said blade edge to slice through the wire's insulation and make physical and electrical engagement with the wire's conductive core, said tube and said blade being dimensioned relative to each other such that as the wire is pulled back, the wire bend slides along the engaged blade edge, said tube flexes to accommodate it, and the bend is firmly wedged between said blade edge and said tube to make a sound electrical and mechanical connection between the wire and said connector, said blade including a storage section adjacent said stop means on which multiple connected wires of like or differing diameters may be stored in wedged engagement between said blade edge and said tube, and wherein said blade edge includes a transition section for guiding the wire bend up onto said storage section of said blade edge when the wire is pulled, said blade further including at the wire inlet end a reinforcing section defining a tubular bore for passing and containing a plurality of wires and for preventing collapsing of the inlet end of said blade during operation.

27. The connector defined by claim 26 wherein at the outlet end thereof, said blade is pinched above the blade bend line at an angle relative to the bend line to enlarge the openings between said blade and said tube on both sides of said blade to facilitate reinsertion of passed wires into the connector, and to strengthen said blade against inward collapsing thereof when the wires are pulled.

28. A wire connector for quickly and easily making collinear interconnection between two flexible electrical wires having an insulated electrically conductive core, comprising:

wire conduit means in the form of a flexible heat-shrinkable plastic tube; and a planar sheet metal double-ended electrically conductive blade captured within said tube, said blade having on each end stop means and adjacent thereto a blade edge, said tube and said blade being structured and arranged such that two wires which are inserted through said tube from opposite ends, reinserted back into the opposite ends of said tube between said tube and the opposed side of said blade, and the wires pulled in opposite directions, will cause the respective bends formed in the wires to be drawn along the respective blade edges toward each other, causing said blade edges to slice through the two wires' insulation and make physical and electrical engagement with the wire cores, said tube and said blade being dimensioned relative to each other such that as the wires are pulled in opposite directions, said tube flexes to accommodate the respective wire bends, and the bends slide along said blade edges and are firmly wedged between said tube and the respective blade edges to make a sound electrical and mechanical connection between the wires, each of said blade edges including a storage section adjacent said stop means on which multiple connected wires of like or different diameters may be stored in wedged engagement between said blade edge and said tube, and wherein each of said blade edges includes a transition section for guiding a wire bend onto said storage section of said blade edge when the wire is pulled.

29. A method of quickly and easily connecting a flexible electrical wire having an insulated electrically conductive core, comprising:

providing a connector comprising a conduit within which is captured an electrically conductive blade;

inserting a wire through the conduit and past the blade;

reinserting the wire back into the outlet end of the conduit but on the opposite side of the blade;

pulling back on the wire such that the bend formed in the wire is drawn along the blade, causing the blade to slice through the wire's insulation and make physical and electrical engagement with the conductive core; and structuring and arranging the conduit and blade such that as the wire is pulled back, the wire bend slides along the blade and is firmly wedged between the conduit and the blade to make a sound electrical and mechanical connection between the wire and the connector.

30. A method of quickly and easily interconnecting a plurality of flexible electrical wires having an insulated electrically conductive core, comprising:

inserting a wire through a conduit within which is captured an electrically conductive blade;

reinserting the wire into the outlet end of the conduit but on the opposite side of the blade;

pulling back on the wire such that the bend formed in the wire is drawn along the blade, causing the blade to slice through the wire's insulation and make physical and electrical engagement with the conductive core;

structuring and arranging the conduit and blade such that as the wire is pulled back, the bend slides along the blade and is firmly wedged between the conduit and the blade to make a sound electrical and mechanical connection between the wire and the connector; and repeating the above procedure with one or more additional wires to effect a sound mechanical and electrical interconnection between all of the wires.

31. The method defined by claim 30 including providing a blade having a "V" cross-section with a blade edge on each leg of the "V", wherein all wires are inserted from the same end, one or more being bent to engage each of the two blade edges.

32. The method defined by claim 30 including providing a planar double-ended blade, and wherein two wires are inserted into opposite ends of the connector, reinserted across opposite ends of the blade and the wires pulled in opposite directions to effect an interconnection therebetween through the electrically conductive blade.

* * * * *